US005826348A

United States Patent [19]

Enderlin et al.

[11] Patent Number: 5,826,348

[45] Date of Patent: Oct. 27, 1998

[54] DEVICE FOR EXPRESSION OF YARN

[75] Inventors: Robert Enderlin, Morschwiller-le-Bas; Didier Thibault, Bru, both of France

[73] Assignee: Superba, Mulhouse, France

[21] Appl. No.: 728,798

[22] Filed: Oct. 10, 1996

[30] Foreign Application Priority Data

Oct. 13, 1995 [FR] France ..... 95 12194

[51] Int. Cl.[6] ..... D06B 15/09; F26B 5/00

[52] U.S. Cl. ..... 34/628; 28/217; 28/299

[58] Field of Search ..... 34/611, 618, 623, 34/627, 628

[56] References Cited

U.S. PATENT DOCUMENTS

| | | | |
|---|---|---|---|
| 2,005,580 | 6/1935 | Ferre | 34/628 X |

FOREIGN PATENT DOCUMENTS

| | | | |
|---|---|---|---|
| 105480 | 10/1938 | Australia | 34/627 |
| 2 575 770 | 7/1986 | France . | |
| 1110124 | 7/1961 | Germany | 34/628 |
| 3 310 878 | 9/1974 | Germany . | |
| 621707 | 4/1949 | United Kingdom | 34/628 |
| 2 009 030 | 6/1979 | United Kingdom . | |

*Primary Examiner*—John J. Calvert
*Attorney, Agent, or Firm*—Young & Thompson

[57] ABSTRACT

A device for expression of yarn, which has a comb (1) for guiding and expressing individual yarns of a layer of yarn. A compressed air blower (2) in line with each interval between two teeth (3) of comb (1) coacts with the comb (1) to cause the expression of excess moisture. The device is more particularly applicable to the field of the textile industry, in particular the field of washing and/or dying yarn.

22 Claims, 2 Drawing Sheets

DEVICE FOR EXPRESSION OF YARN

FIELD OF THE INVENTION

The present invention relates to the field of the textile industry, in particular the treatment by washing and/or dying of yarn and has for its object a device for expressing yarn.

BACKGROUND OF THE INVENTION

Textile yarn is generally subjected, before use, particularly for weaving, to treatments of washing and/or bleaching as well as dying. The different treatments are effected wet, having for a result an excess of moisture of the order of 100% to 150% by weight, and requiring a subsequent drying operation.

At present, the drying operation is carried out by the supply of energy in the form of heat and/or a current of air to effect evaporation of the excess moisture. Such a drying gives rise to a very high consumption of energy, and, as a result, a high production cost.

It is also known to carry out mechanical spin drying, particularly of skeins or spools, by means of centrifugal devices. In such a case, a residual moisture content of 50% can be obtained very rapidly with low energy expenditure. However, these spin-drying operations are not useful in the field of treating continuous yarn, which is to say when the yarns are moving lengthwise and are disposed in layers.

Finally, there is also known a process for expressing excess moisture by high air pressure. Such expression permits means comparable to those obtained by mechanical spin drying. However, in the case of the treatment of yarn in layers, such an expression operation is not suitable, the yarns being unsupported during treatment by air jet and being in danger of being tangled under the influence of said jet.

SUMMARY OF THE INVENTION

The present invention has for its object to overcome the drawback of the expressing devices known until now, by providing a yarn expressing device adapted for the treatment of a layer of yarn, permitting optimum expression of each yarn of the layer and easy emplacement of the yarns of the layer in said device.

To this end, the yarn expression device is characterized in that it is essentially constituted by a comb for guiding and expressing individual yarns of a layer of yarn and by means of blowing compressed air in line with each interval between two teeth of said comb, this air blowing means coacting with the comb to effect expression of excess moisture.

DESCRIPTION OF THE DRAWINGS

The invention will be better understood from the following description, which relates to a preferred embodiment, given by way of non-limiting example and explained with reference to the accompanying schematic drawings, in which.

DETAILED DESCRIPTION OF THE INVENTION

Figure 1:
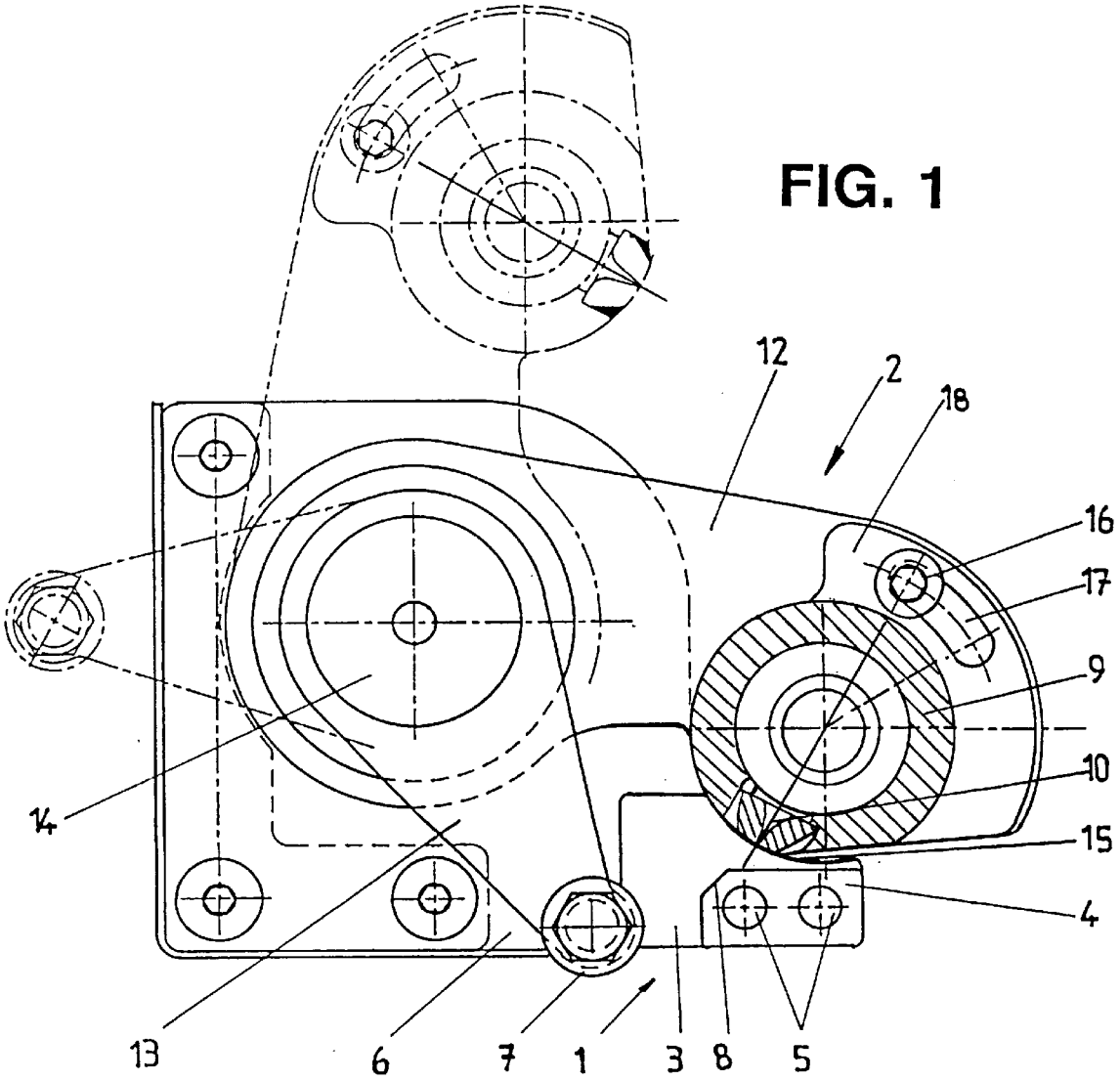
FIG. 1 is a side elevational and cross-sectional view of a device according to the invention.
Figure 2:
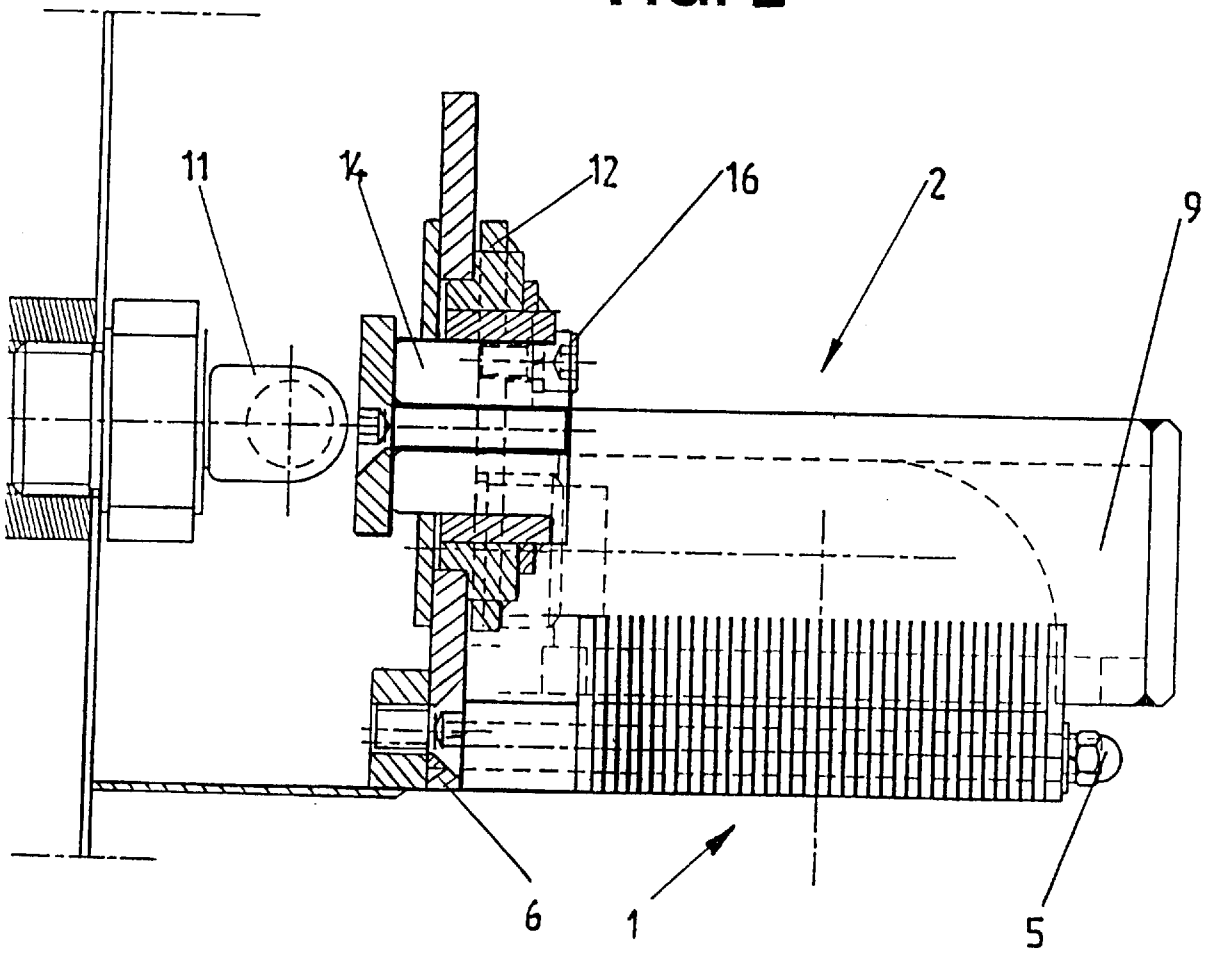
FIG. 2 is a front elevational view in cross section of a device according to FIG. 1.

According to the invention, and as shown more particularly by way of example in FIGS. 1 and 2 of the accompanying drawings, the yarn expression device is essentially constituted by a comb 1 for guiding and expressing individual yarns of a layer of yarn and by compressed air blowing means 2 in line with each interval between two teeth 3 of said comb 1, this air blowing means 2 coacting with the comb 1 to effect expression of excess moisture.

The comb 1 is preferably constituted by an assembly of teeth 3 and spacers 4 disposed between said teeth 3 and by at least one gripping spindle 5 for said teeth 3 and spacers 4 on a support 6 (FIGS. 1 and 2). Such a construction of comb 1 permits easy adaptation of the latter to a predetermined number of yarns of a layer, by simple demounting of the spindle 5 from the support 6 and mounting or unmounting the necessary number of pairs of teeth and spacers, then remounting the spindles 5 in the new arrangement on the support 6.

The teeth 3 are preferably in the form of thin plates, whose planar section extends substantially beyond that of the spacers 4. Such an embodiment of teeth 3 and spacers 4 permits precise guidance of each yarn between two successive teeth and the expression of the moisture from one yarn independently of the other, which is to say without said yarns being able to enter into contact before and during said expressing.

The spacers 4, which are interchangeable, have thicknesses variable as a function of the metric number of the yarn to be treated. Thus, according to the metric number or the diameter of the yarn, the comb 1 is entirely dismounted and the spacers 4 suitable for said metric number are mounted on the spindles 5 between the plates forming the teeth 3. The assembly being clamped on the support 6. As a result, the yarns of a layer are always guided in an optimum manner between the teeth 3.

The device is completed moreover by a cylinder 7 for diverting the layer of yarn extending, in the service position, at least partially below the level of the spacers 4 of the comb 1 (FIG. 1), so as to apply the yarns of the layer obliquely against the corresponding edges of the spacers 4. Thus, by the effect of rubbing of the yarn against the edge of the spacers 4 and, by virtue of the tension of the layer of moving yarn, there is obtained a substantial expression of the moisture due to relative crushing of the yarn against the spacers 4.

So as to avoid damage to the yarn during the expression operation, the spacers 4 preferably have, seen from the inlet of the yarn into the comb 1, a chamfer 8 or a rounding. Thus, the yarns of the layer which are diverted by the cylinder 7 are applied with predetermined pressure against the chamfer 8 or the rounding of the spacers 4 and, under the effect of pressure resulting from application by the cylinder 7 and the traction on the yarn, there is obtained a substantial mechanical expression of the moisture from the yarn.

Air blowing means 2 are present in the form of an elongated manifold 9, extending parallel above the comb 1 and delivering a flat jet through a slot 10, said manifold 9 being connected to compressed air supply means by means of a coupler 11.

According to a modified embodiment of the invention, not shown in the accompanying drawings, the air blowing means 2 could also be present in the form of a manifold of parallel cylindrical jets, whose air blowing holes have a diameter corresponding to that of the yarn to be expressed.

According to another characteristic of the invention, the manifold 9 is preferably mounted pivotably on the support 6 of the comb 1 by means of a lever 12, the coupler 11 of the supply means being in the form of a sealed rotating coupler, whose axis of rotation is aligned with that of the lever 12. Such an embodiment permits, as shown in FIG. 1 of the accompanying drawings, in broken line, a pivoting of the lever 12 with the manifold 9 out of the region of coaction with the comb 1, so as to permit emplacement of the yarns between the teeth 3 of the comb 1.

To this end, according to another characteristic of the invention, the deflection cylinder 7 is also mounted on a pivoting lever 13, whose pivotal axis is aligned with that of the lever 12 of the support of the manifold 9.

The lever 12 for supporting the manifold 9 and the lever 13 for supporting the diverting cylinder 7 are preferably mounted on a common pivotal bearing 14 (FIG. 1).

According to another characteristic of the invention, the plates forming the teeth 3 of the comb 1 have, on their side turned toward the manifold 9, in the service position of this latter, a cutout 15 corresponding substantially to the section of said manifold 9 (FIG. 1). Thus, the manifold 9 can be swung into the service position at a distance from the spacers 4 of the comb 1 which is very small and limited by the cutout 15 of the plates forming the teeth 3.

When the manifold 9 is thus in abutment against the teeth 3, its blowing slot 10 will be located at a very small distance above the yarns of the layer of yarns whose expression must be effected and deliver a jet of air in the direction of the inlet of the yarns between the teeth 3 of the comb 1 and drive the moisture present in these latter and/or already partially expressed against the chamfer 8 or the rounding of the spacers 4, through the teeth 3 into the space located below the support 6.

According to one characteristic of the invention, and as shown in FIG. 1 of the accompanying drawings, the manifold 9 is mounted on its pivotable support lever 12 so as to be adjustable in rotation about its longitudinal axis, with the possibility of blocking in position by means of a screw 16 coacting with an oblong groove 17 passing through a flange 18 secured to the corresponding end of the manifold 9. Thus, the blowing slot 10 and the manifold 9 can be adjusted in the direction of the chamfer or rounding 8, in an optimum manner, by simple rotation of the manifold 9, then blocking in position of this latter by gripping the flange 18 on the lever 12 by means of the screw 6.

According to another characteristic of the invention, not shown in the accompanying drawings, the cross section of the blowing slot can be adjustable mechanically by provision of movably spaced edges, by means of screws, particularly by oblique displacement relative to the axis of blowing, or again by mounting the edges of the slot on removable wedges.

Such an adjustment of the cross section of the blowing slot 10 can be particularly interesting to influence the speed of the blowing air current, with constant pressure and flow rate, and thus on the optimum transport capacity of the air for the moisture.

Figure 3:
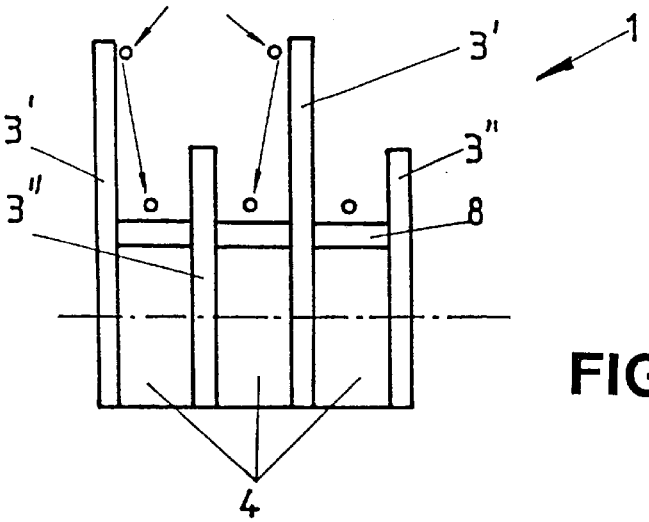
FIG. 3 is a fragmentary cross-sectional view on a larger scale of a modified embodiment of the comb for guiding and expressing.

FIG. 3 of the accompanying drawings shows partially and on a larger scale a modified embodiment of the comb 1 in which the teeth 3 are of two types, 3' and 3", having different heights and disposed in alternation.

As is seen more particularly in FIG. 3, a higher tooth 3' is always preceded and followed by a less high 3", such that the spacing between the corresponding surfaces of the two higher teeth 3' is enlarged and such that for emplacing two yarns between these two higher teeth 3' and the intermediate lower tooth 3", it suffices to apply the first yarn against the internal surface of the first higher tooth 3' and to let it descend between this tooth 3' and the lower tooth 3" until it comes into contact with the spacer 4, whilst the other yarn can be applied against the corresponding internal surface of the second higher tooth 3', then caused to descend into contact with the spacer 4 between the lower tooth 3" and the higher tooth 3'. Thus, an emplacement without risk of error, in particularly of tangling of yarns, is greatly facilitated.

After emplacement of the assembly of yarns on the comb 1, the levers 12 and 13 can be actuated so as to bring the manifold and the deflection cylinder 7 into the service position shown in FIG. 1 of the accompanying drawings, and a continuous operation of expressing can be started simultaneously with the supply of air under pressure to the manifold 9. All the yarns passing through the device according to the invention are subjected to a detour applying them against corresponding spacers 4 and having for the effect to cause mechanical expression of their residual moisture, complementary expression by a jet of air under pressure being provided by the air under pressure blown through the slot 10 of the manifold 9 against the forward portion of the spacers 4, the air thus blown carrying out moreover the transport and evacuation of the moisture thus expelled from the comb 1 into the space below this latter and below its support 6.

Thanks to the invention, it is possible to effect substantial expression of the moisture from washed or dyed yarns with gains comparable to those obtained by spin drying, but this on yarns continuously moving lengthwise.

Of course, the invention is not limited to the embodiment described and shown in the accompanying drawings. Modifications remain possible, particularly as to the construction of the various elements or by substitution of technical equivalents, without thereby departing from the scope of protection of the invention.

What is claimed is:

1. A yarn expression device comprising a comb (1) having a plurality of spaced teeth for guiding and expressing individual yarns of a layer of yarn and means (2) for blowing compressed air in line with each interval between two teeth (3) of said comb (1), the air-blowing means (2) being present in the form of an elongated manifold (9) extending parallel above the comb (1) and delivering a flat let through a slot (10), said manifold (9) being connected to a compressed air supply means via a coupling (11), and said air-blowing means (2) and the comb (1) acting to effect expression of excess moisture from the yarn.

2. A device according to claim 1, wherein the comb (1) comprises spacers (4) disposed between said teeth (3) and at least one spindle (5) for locking said teeth (3) and spacers (4) on a support (6).

3. A device according to claim 2, wherein said teeth (3) are present in the form of thin plates.

4. A device according to claim 2, wherein the spacers (4) are interchangeable and have thicknesses that are variable as a function of the metric number of the yarn to be treated.

5. A device according to claim 2, further comprising a diversion cylinder (7) for the layer of yarn extending in a service position at least partially below the spacers (4) of the comb,(1), so as to apply the yarns of the layer obliquely against the corresponding edge of the spacers (4).

6. A device according to claim 2, wherein the spacers (4) have, at an inlet of the yarn into the comb (1), a chamfer (8) or a rounded edge that contacts the yarn.

7. A device according to claim 5, wherein the deflection cylinder (7) is mounted on a pivoting lever (13) whose pivotal axis is aligned with that of a support lever (12) of an air-supply manifold (9).

8. A device according to claim 7, wherein the support lever (12) for the manifold (9) and the support lever (13) of the deflection cylinder (7) are mounted on a common pivotal bearing (14).

9. A device according to claim 1, wherein small plates forming the teeth (3) of the comb (1) have, on their side turned toward the manifold (9), when the manifold is in service position, a cutout (15) corresponding substantially to the section of said manifold (9).

10. A device according to claim 1, wherein the manifold (9) has a longitudinal axis and is mounted on a pivotable support (12) in a manner adjustable in rotation about said longitudinal axis, the device further comprising a screw (16) coacting with an oblong groove (17) passing through a flange (18) secured to a corresponding end of the manifold (9) for locking said manifold in position.

11. A device according to claim 1, wherein a section of the blowing slot (10) of the manifold (9) is mechanically adjustable by provision of edges of adjustable spacing, by means of screws, with oblique displacement relative to the blowing axis.

12. A device according to claim 1, wherein the teeth (3) of the comb (1) are of two types (3', 3") having different heights and disposed in alternation.

13. A yarn expression device comprising a comb (1) having a plurality of spaced teeth for guiding and expressing individual yarns of a layer of yarn and means (2) for blowing compressed air in line with each interval between two teeth (3) of said comb (1), the air-blowing means (2) being present in the form of a manifold with cylindrical parallel jets that comprise air-blowing openings having a diameter corresponding to that of the yearn to be expressed, and said air-blowing means (2) and the comb (1) acting to effect expression of excess moisture from the yarn.

14. A device according to claim 13, wherein the comb (1) comprises spacers (4) disposed between said teeth (3) and at least one spindle (5) for locking said teeth (3) and spacers (4) on a support (6).

15. A device according to claim 14, wherein said teeth (3) are present in the form of thin plates.

16. A device according to claim 14, wherein the spacers (4) are interchangeable and have thicknesses that are variable as a function of the metric number of the yarn to be treated.

17. A device according to claim 14, further comprising a diversion cylinder (7) for the layer of yarn extending in a service position at least partially below the spacers (4) of the comb (1), so as to apply the yarns of the layer obliquely against the corresponding edge of the spacers (4).

18. A device according to claim 14, wherein the spacers (4) have, at an inlet of the yarn into the comb (1), a chamfer (8) or a rounded edge that contacts the yarn.

19. A device according to claim 13, wherein the manifold (9) is mounted pivotably on a support (6) of the comb (1) by means of a lever (12), a coupler (11) to a supply of compressed air being in the form of a sealed rotatable coupling whose axis of rotation is aligned with that of the lever (12).

20. A device according to claim 17, wherein the deflection cylinder (7) is mounted on a pivoting lever (13) whose pivotal axis is aligned with that of a support lever (12) of an air-supply manifold (9).

21. A device according to claim 20, wherein the support lever (12) for the manifold (9) and the support lever (13) of the deflection cylinder (7) are mounted on a common pivotal bearing (14).

22. A device according to claim 13, wherein the teeth (3) of the comb (1) are of two types (3', 3") having different heights and disposed in alternation.

* * * * *